United States Patent [19]

Williams

[11] 4,335,758

[45] Jun. 22, 1982

[54] APPARATUS FOR ADVANCING AND FORMING A WIRE

[75] Inventor: Stanley E. Williams, McLeansboro, Ill.

[73] Assignee: George Koch Sons, Inc., Evansville, Ind.

[21] Appl. No.: 225,302

[22] Filed: Jan. 15, 1981

Related U.S. Application Data

[63] Continuation of Ser. No. 47,213, Jun. 11, 1979, abandoned.

[51] Int. Cl.[3] ..... B21F 1/02

[52] U.S. Cl. ..... 140/88; 140/102; 140/147

[58] Field of Search ..... 140/147, 102, 88; 226/162, 167

[56] References Cited

U.S. PATENT DOCUMENTS

| | | | |
|---|---|---|---|
| 1,074,564 | 9/1913 | Weber | 140/147 |
| 2,111,308 | 3/1938 | Baxendale | 226/167 |
| 2,228,745 | 1/1941 | Berkebil | 140/147 |
| 2,511,274 | 6/1950 | Kramer | 140/147 |
| 3,196,906 | 7/1965 | Sjobohm et al. | 140/102 |
| 3,429,493 | 2/1969 | Lehmann | 226/162 |
| 3,741,458 | 6/1973 | Aylesworth | 226/162 |
| 3,744,536 | 7/1973 | Stahl, Jr. et al. | 140/88 |
| 4,059,213 | 11/1977 | Toomay | 226/167 |

*Primary Examiner*—John McQuade

*Attorney, Agent, or Firm*—Jenkins, Coffey, Hyland, Badger & Conard

[57] ABSTRACT

This invention relates to an apparatus for advancing a strand of wire a specific and predetermined distance. The apparatus can be used in conjunction with a cutting device alone, or with a forming device to also produce articles of desired shapes. An additional aspect of the invention is an anti-backing chuck to hold and move the wire in the advancing apparatus.

4 Claims, 6 Drawing Figures

APPARATUS FOR ADVANCING AND FORMING A WIRE

This is a continuation of application Ser. No. 047,213, filed June 11, 1979, now abandoned.

The present invention relates to an apparatus for advancing a strand of non-flexible material and forming it into a ring or other shape. The invention also relates to an anti-backing chuck for use in the advancing apparatus.

In forming the finished product, the wire or other material must be uncoiled, straightened, advanced, formed, cut, and collected. In the past, it has been difficult to perform these steps quickly and accurately. The present invention is able to accomplish all of these steps with great speed and accuracy on a single apparatus. It is therefore an object of this invention to provide for the rapid and accurate advancement of a strand. It is a further object of this invention to provide for the forming, cutting, and collection of finished rings or polygons. It is still a further object of this invention to provide for the straightening, advancement, forming, cutting, and collecting of the strand by a single apparatus.

Figure 3:
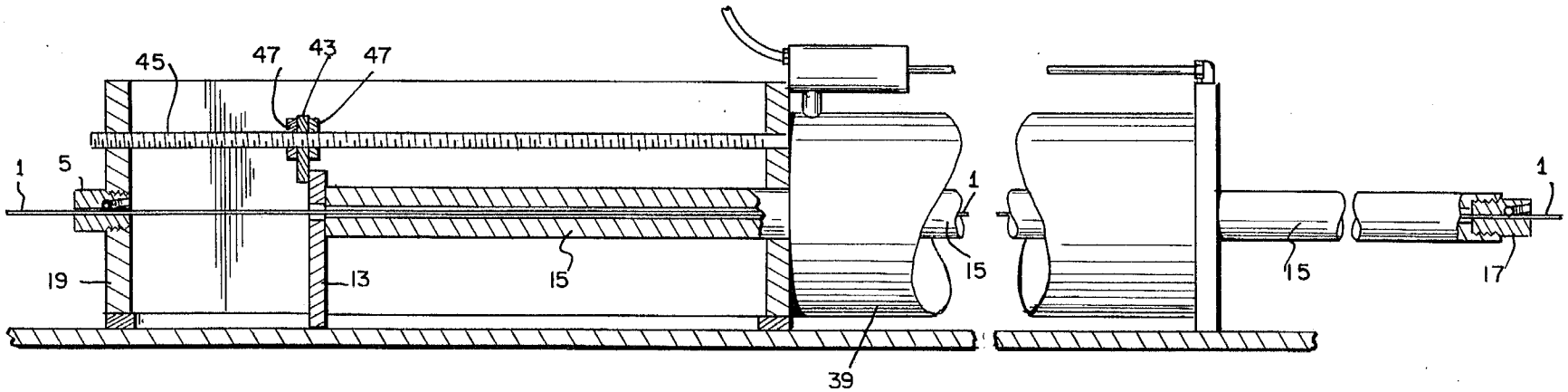
FIG. 3 is a cross-sectional view of an advancing mechanism employed in the apparatus shown in FIG. 2.
Figure 5:
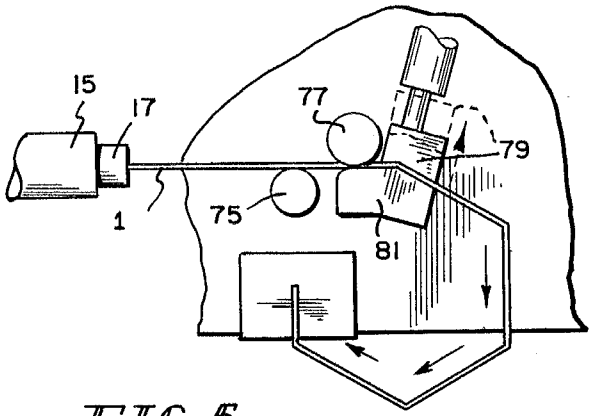
Figure 4B:
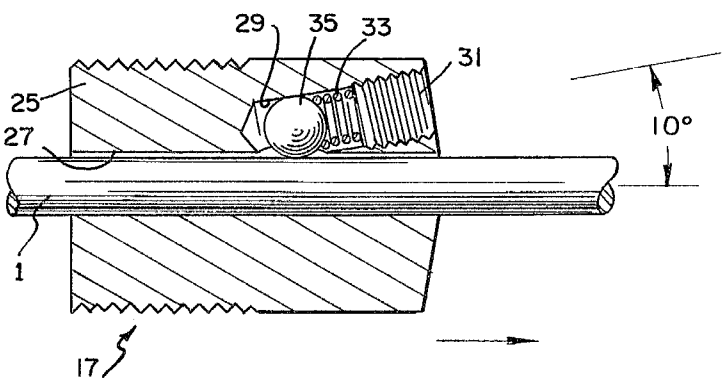
Figure 4A:
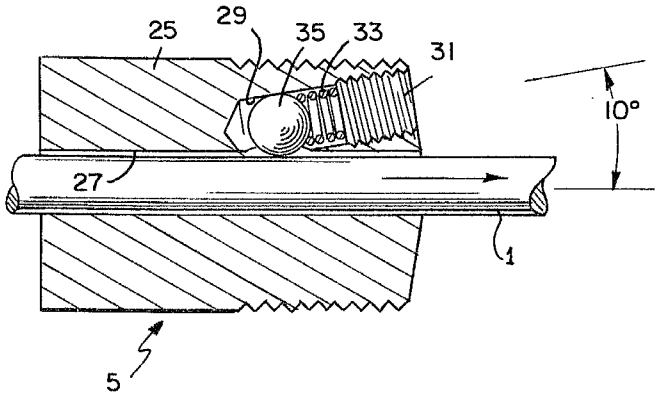

FIGS. 4*a* and 4*b* are cross-sectional views of an anti-backing chuck employed in the mechanism shown in FIG. 3; and FIG. 5 is an elevational view of a hex-forming apparatus.

Briefly, the apparatus of the present invention automatically and rapidly advances a strand of non-flexible material a desired length to form an article of desired shape. By passing the strand through a series of rollers, the strand of material is first straightened. A pair of unidirectional chucks cooperate in a reciprocating motion to advance the strand, and movable sensing devices are employed to indicate when a desired length of the strand has been advanced. Accordingly, advancement of the strand is variably controllable. Also included are means for forming each desired length of strand advanced by the apparatus into a desired shape, cutting the formed strand and collecting the formed pieces.

Figure 1:
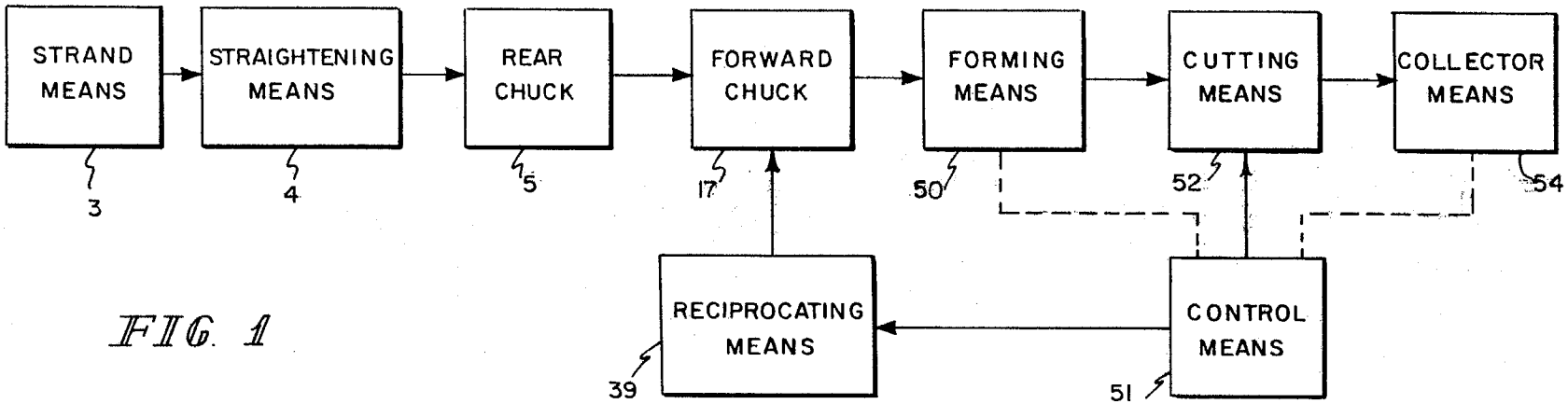
FIG. 1 is a flow diagram showing the relationship of various portions of the apparatus constructed in accordance with the present invention.

FIG. 1 is a flow diagram showing the functional relationship between the various elements comprising the apparatus of the present invention. Each of the elements is identified and its relationship generally represented by the numerals and arrows shown in FIG. 1. The specific embodiments of and the functions associated with each element will be described in more detail later; however, in general, an apparatus constructed in accordance with the present invention functions as follows. A supply of wire or other non-flexible strand material is supplied at the rear of the apparatus. The wire is guided into the apparatus and then straightened. A rear chuck prevents any reverse movement of the strand, and a forward chuck carries the wire forward when acted upon by a reciprocating means. The strand is then formed, cut and collected.

Figure 2:
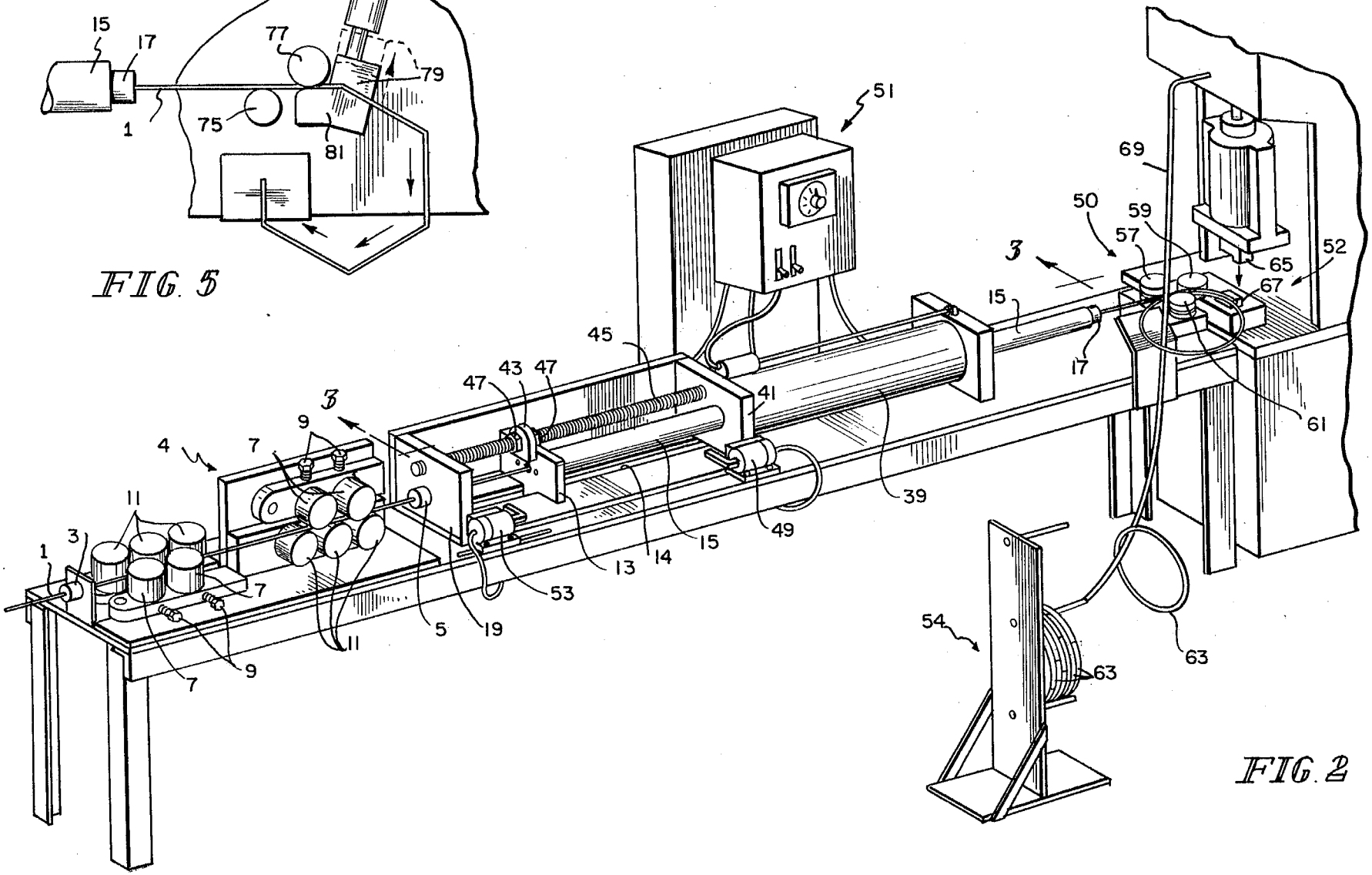
FIG. 2 is a perspective view of the apparatus of the present invention.

Referring now to FIG. 2, a wire 1 passes through a guide 3, including a hole which is colinear with a rear anti-backing chuck 5. The wire 1 is pulled through two sets of straightening rollers 4. Each set of rollers has a movable row of rollers 7, positioned by bolts 9, and a stationary row of rollers 11.

In variations, all rollers may be made stationary if a single size wire is always used, or all may be adjustable to accommodate a variety of wire sizes. Additionally, these rollers may have special faces for use with particular wire shapes, sizes and compositions.

The wire, after being straightened, passes through rear anti-backing chuck 5, plate 13, hollow rod 15 and forward anti-backing chuck 17. The anti-backing chucks are identical in manufacture and orientation except that in the illustrated embodiment they are mounted from opposite sides so that in one instance the wire 1 is prevented from being retracted and in another instance the wire 1 is advanced.

The chuck itself has a body which is threaded on either the forward or rear end, for mounting on either support 19 or hollow rod 15, respectively. Referring now to FIGS. 4*a* and 4*b*, the body 25 has a centrally located primary bore 27 through which the wire 1 passes generally in the direction indicated by the arrows. A secondary bore 29 extends partially into the primary bore 27. The axes of the two bores are coplanar and intersect at an angle of 10°. For some purposes, a greater or lesser angle may be used, but 10° has been found to be optimal. Plug 31 holds spring 33 against ball 35. When a wire is first inserted from the rear of the chuck 5 or 17, it pushes the ball 35 against the bias of the spring 33 until there is sufficient clearance for the wire to pass through the chuck.

It should be noted that the secondary bore 29 extends only partially into the primary bore 27. Accordingly, the sides of the secondary bore 29 are maintained over more than 180° of the circumference of the secondary bore 29 and the ball 35 cannot fall into the primary bore when no wire is present.

In rear anti-backing chuck 5, the chuck will allow movement of the wire in a forward but not reverse direction as indicated generally by the arrows. When the wire is pulled forward, it will tend to roll the ball 35 against the bias of the spring 33, allowing space for the wire to pass. When the wire is pulled in the reverse direction, the wire rolls the ball 35 in the direction of the spring bias, narrowing the space for the wire, and causing the wire to seize in the chuck. The operation of forward anti-backing chuck 17 is identical, except that the forward chuck 17 moves while the rear chuck 5 is stationary.

By way of example and not by way of limitation, the following specific dimensions are presented as typical of an optimal embodiment of this invention. A primary bore of 0.3280 inches (0.8331 cm.) is provided for a 5/16 inch (0.7937 cm.) ball to have a maximum penetration into the bore of 0.050 inch (0.127 cm.).

As shown in FIG. 2, the rear chuck 5 is mounted on support 19 and is oriented for forward movement of the wire. The forward chuck 17 is mounted on the forward end of hollow rod 15 and is in the same orientation as the rear chuck 5.

As the forward chuck 17 moves forward, it carries the wire with it; and on its return stroke, it slides over the wire. The action of the rear chuck 5 is to prevent any backward movement of the wire through the friction of the hollow rod 15 and forward chuck 17 during their return stroke, or from compression of the wire against the forming mechanism.

Fluid cylinder 39 powers the reciprocal movement of hollow rod 15. Hollow rod 15 has attached to its plate 13 movable within a T-shaped slot 14 which limits the movement of hollow rod 15 by contact with support 41 and stop 43. Stop 43 is threadedly mounted on bar 45 and is fastened by lock nut 47. The thread of bar 45 is chosen such that one turn of stop 43 will cause a lengthwise movement equal to one increment in the adjustment of the travel of hollow rod 15. Alternatively, stop 43 may be slidably mounted on bar 45 and held in place by a nut on each side, thus allowing for an infinitesimal incremented adjustment.

Fluid cylinder 39 will move hollow rod 15 in a forward direction until forward limit switch 49 is hit by plate 13. Upon activation of forward limit switch 49, control 51 causes fluid cylinder 39 to reverse the direction of movement of hollow rod 15 and direct it backwards. Hollow bar 15 will continue to travel backwards until rear limit switch 53 is hit by plate 13 and control 51 again reverses the direction of travel of hollow rod 15. Importantly, it should be noted that limit switch 53 is also adjustable so that it may be correspondingly moved in accordance with adjustment made to stop 43. Stop 43 and support 41 act as absolute limits to the movement of hollow rod 15 and to prevent damage to the switches 49 and 53.

Fluid cylinder 39 may be a hydraulic or air system. The particular construction of control 51 and fluid cylinder 39 will be readily ascertainable to those skilled in the art, in light of the present disclosure. In variations, hollow bar 15 could be driven by an electric motor, a solenoid, or any of many available power sources.

As wire 1 is advanced, it is pushed into the forming mechanism 50. In FIG. 2, the illustrated forming mechanism is a set of rollers 57, 59, and 61, arranged to produce wire rings 63. As the wire is advanced, it is stabilized by roller 57 and bent by rollers 59 and 61 acting in cooperation with roller 57. A cutting device 52 consisting of blades 65 and 67 then cuts the formed ring. As is known to those skilled in the art, many variations of the rollers are possible. Their positions may be altered to change the size and flatness of the finished wire ring 63. Furthermore, if the rollers are not coplanar, a spiral may be produced.

The forming mechanism may also produce a polygon. As shown in FIG. 5, a regular hexagon may be press-formed. In this modification, as forward chuck 17 feeds wire 1, rollers 75 and 77 guide the wire. After the wire is advanced and has stopped, block 79 presses the wire against anvil 81 to form the bend.

Block 79 is then retracted, the wire advanced, and the process repeated. By adjusting the angle of the faces of block 79 and anvil 81, the shape of the polygon may be varied. By changing the length of the stroke of hollow rod 15, the size of the polygon may be altered. It will be understood that the mechanism shown in FIG. 5 is merely illustrative and therefore any number of forming devices and methods may be employed to form polygon shapes from the advanced wire 1.

This invention is ideal for the manufacture of a quantity of strand segments of uniform and predetermined length. In such case, the forming apparatus is replaced by a cutting apparatus alone, activated by control 51.

When pushing a wire, it has a tendency to bend. This bending tendency decreases as the force opposing the pushing and the length of the wire decrease. Accordingly, it will be often desirable to adjust the apparatus of control 51 to advance hollow rod 15 a plurality of short strokes rather than a single large stroke. Also, by using more than one stroke of hollow rod 15, the length or circumference of the strand product is not limited by the length of the stroke of hollow rod 15.

When a straight wire is advanced and cut, the apparatus will be adjusted according to the expression:

$$l_s \times N_s = l_t$$

where $l_s$ is the length of stroke of hollow rod 15, $N_s$ is the number of strokes and $l_t$ is the total length of the wire product.

When the wire is being advanced into a ring forming apparatus, the length of stroke of hollow rod 15 will be set according to the expression:

$$(l_s \times N_s) + j = c,$$

where $l_s$ is the length of stroke of hollow rod 15, $N_s$ is the number of strokes, j is the space between the ends of the ring used for the joint and c is the circumference of the finished ring. The allowance for j will often be small enough to be ignored; and in cases where the joining process consumes the metal of the ring, j may have a negative value.

The value of c must be qualified. Depending on the composition of the wire and the forming processes when the wire is formed into a ring, to some extent the metal on the inside of the ring will be compressed and that on the outside of the ring will be expanded. If the forming produces no outside expansion and only inside compression, c is the outside circumference. If the opposite is true, then c is the inside circumference. Thus, depending on the wire and forming apparatus used, the operator must allow for the tendency of the wire to compress or expand.

As shown in FIG. 2, the rings 63 are made on a horizontal plane and are then cut. The ring may then, depending on the design of the forming apparatus, fall naturally or be pushed off the forming rollers 57, 59, and 61. In the embodiment shown, the rings 63 are formed around cable 69 such that when they fall off the forming rollers they slide along cable 69 and are collected in a group. The rollers may be alligned for vertical forming of the rings to aid in this fall off and collection procedure.

Of importance in FIG. 2, cutting blades 65 and 67 are positioned to cut the wire from the leading end of the new ring to be formed after this leading end has already passed through the forming coils 57, 59, and 61. Thus, a cut end of the wire is passed into the forming coils only when a new strand is introduced into the apparatus. So there are none of the problems associated with the initial introduction of a straight wire into the forming rollers except when a new spool of strand is fed into the machine.

While a metal wire is suggested as the supply material to be formed, any strand or wire-like material may be used provided it is of sufficient strength to withstand the advancing and forming process.

As is well known, circular wire rings are widely used in the construction of various types of apparatus such as metal furniture, etc. Accordingly, a great need has heretofore existed for a machine and method for economically producing wire rings having exact dimensions.

The apparatus of the present invention, as evidenced by the description hereinabove, satisfies this need by controllably and accurately advancing exact lengths a wire strand and forming such strands into circular wire rings in a single automated operation. In addition, the present apparatus may be quickly adjusted by the operator so as to form wire rings of various diameters, thereby providing a high degree of flexibility. In fact, the operator may periodically interrupt the process of forming wire rings of one diameter and controllably adjust the apparatus so that wire rings of another diameter are formed without changing or removing the wire strand. Accordingly, the time required to set up the apparatus to produce various sizes of wire rings is greatly minimized.

I claim:

1. An apparatus for advancing a strand comprising:

one or more anti-backing chucks for allowing movement of a strand in a forward direction and restraining movement in a rearward direction;

means for reciprocally moving one of said chucks to a forward position during which the strand is carried forward by said chuck, and to a rear position during which the strand is not moved by said chuck;

said means for moving said one chuck including a piston and cylinder mechanism, a hollow member extending axially through the piston and cylinder mechanism and having first and second ends extending axially outward therefrom for receiving the strand, the hollow member being connected to and reciprocally movable in response to the piston and cylinder mechanism, said chuck being coupled to said first end of the hollow member; and means for adjustably controlling the reciprocating motion of said one chuck to gauge the quantity of the strand being advanced with each reciprocating motion, said control means including stop means variably positionable relative to said second end of the hollow member for establishing absolute limits of movement of the hollow member, sensing means variably positionable relative to the second end of the hollow member for detecting the movement of said chuck to its forward and rear positions and communicating with said piston and cylinder mechanism to reverse the direction of movement of said hollow member, means coupled to the hollow member for engaging the sensing means and stop means, the stop means being variably positioned in proximity to the sensing means to prevent damage to the sensing means, means for forming the advanced portion of the strand into a desired shape in response to the reciprocating motion of the hollow member, and means for cutting the strand to produce an article having the desired shape and a size determined by the quantity of strand advanced.

2. An apparatus for advancing a strand comprising a first chuck of unidirectionally limiting movement of the strand, a hollow member positioned colinearly with respect to the first chuck for receiving the strand, a second chuck for unidirectionally limiting movement of the strand coupled to the hollow member and having the same directional orientation as the first chuck, a piston and cylinder mechanism coupled to the hollow member and reciprocally moving the hollow member to cause the second chuck to reciprocate and thereby advance the strand, the hollow member extending axially through the piston and cylinder mechanism and having first and second ends extending outward therefrom, the second chuck being coupled to the first end of the hollow member, means for limiting the length of the stroke associated with the reciprocal movement of the second chuck, the limiting means including stop means variably positionable relative to the second end of the hollow member for limiting movement of the hollow member, means coupled to the hollow member for engaging the stop means, sensing means variably positionable relative to the second end of the hollow member for detecting the movement of the hollow member and for controlling the the piston and cylinder mechanism to reverse the direction of movement of the hollow member to thereby gauge the length of the strand being advanced with each reciprocating motion, means for forming the advanced portion of the strand into a desired shape in response to the reciprocating motion of the hollow member, and means for cutting the strand to produce an article having the desired shape and a size determined by the quantity of strand advanced.

3. The apparatus of claim 2 further including means for straightening the strand prior to it being advanced through the first chuck.

4. An apparatus for advancing a strand comprising at least one anti-backing chuck for allowing movement of a strand in a forward direction and restraining movement in a rearward direction, a piston and cylinder mechanism for moving the chuck to a forward position during which the strand is carried forward by the chuck and to a rear position during which the strand is not moved by the chuck, a hollow member extending axially through the piston and cylinder mechanism and having first and second ends extending axially outward therefrom for receiving the strand, the hollow member being connected to and reciprocally movable in response to the piston and cylinder mechanism, the chuck being coupled to the first end of the hollow member, stop means variably positionable relative to the second end of the hollow member for engaging and limiting movement of the hollow member, sensing means variably positionable relative to the second end of the hollow member for detecting its movement and signalling the piston and cylinder mechanism to control the reciprocating motion of the hollow member to thereby gauge the length of the strand being advanced with each reciprocating motion, means for bending the advanced portion of the strand to form shaped articles in response to the reciprocating motion, and means for cutting the advance strand in multiples of the advanced length of the strand to determine the size of the articles.

* * * * *